US005314099A

United States Patent [19]

Butz et al.

[11] Patent Number: 5,314,099

[45] Date of Patent: May 24, 1994

[54] CASTING SPOUT FOR METALLURGICAL VESSELS

[75] Inventors: Hans Butz, Duisburg; Gerd Diederich, Erpel; Hans-Juergen Ehrenberg, Duesseldorf; Dietmar Lohse, Wesel; Lothar Parschat, Ratingen; Fritz-Peter Pleschiutschnigg, Duisburg, all of Fed. Rep. of Germany

[73] Assignee: Mannesmann AG, Düsseldorf, Fed. Rep. of Germany

[21] Appl. No.: 415,320

[22] PCT Filed: Mar. 16, 1988

[86] PCT No.: PCT/DE88/00172

§ 371 Date: Sep. 19, 1989

§ 102(e) Date: Sep. 19, 1989

[87] PCT Pub. No.: WO88/06932

PCT Pub. Date: Sep. 22, 1988

[30] Foreign Application Priority Data

Mar. 20, 1987 [DE] Fed. Rep. of Germany ..... 3709188

[51] Int. Cl.[5] ..... B22D 41/50

[52] U.S. Cl. ..... 222/606; 222/591; 164/337

[58] Field of Search ..... 222/590, 591, 606, 607; 164/337

[56] References Cited

U.S. PATENT DOCUMENTS

| | | | |
|---|---|---|---|
| 3,991,815 | 11/1976 | Fastner et al. | 164/337 |
| 4,210,264 | 7/1980 | Kondo | 222/591 |
| 4,220,618 | 9/1980 | Pierson, Sr. et al. | 264/219 |
| 4,852,633 | 8/1989 | Teshima et al. | 164/337 |
| 4,904,626 | 2/1990 | Shaffer | 222/606 |

FOREIGN PATENT DOCUMENTS

| | | |
|---|---|---|
| 1959097 | 11/1970 | Fed. Rep. of Germany . |
| 2105881 | 8/1972 | Fed. Rep. of Germany . |
| 2243043 | 4/1975 | France . |
| 2525937 | 11/1983 | France . |

OTHER PUBLICATIONS

1

*Primary Examiner*—Scott Kastler
*Attorney, Agent, or Firm*—Ralf H. Siegemund

[57] ABSTRACT

An immersion nozzle (2) for metallurgical recipients, in particular for a reservoir arranged upstream of a continuous casting ingot mould, has an interchangeable discharge pipe (2) which can be attached in a leakproof manner on or in a perforated brick (1). To improve the flow conditions and hence the efficiency of the casting, the inlet side of the nozzle comprises an upper elongated section (12) in the form of a tubular shaft (11) which expands conically downward to a given plane and which is narrow in a plane perpendicular to the given plane. A second elongate section (13) ends in an elongated transverse flow section of given dimensions.

4 Claims, 2 Drawing Sheets

CASTING SPOUT FOR METALLURGICAL VESSELS

The invention relates to a casting spout for metallurgical vessels particularly for a tundish arranged upstream of a mold for continuous casting and more particularly to a casting spout fastened to such a tundish, for purposes of casting thin ingots, the spout is assumed to have an upper portion of tubular shaft configuration and lower portion which widens conically in downward direction.

The basic body of such a casting spout is comprised of alumina or clay material mixed with graphite and being highly wear resistant with respect to liquid steel and the graphite component is protected against burn-off or going in solution with the steel. Discharge pipes constructed as casting spouts for so-called slab ingots whose cross sections have dimensions of about 300 mm by 2600 mm. These discharge pipes require a particularly suitable geometric configuration concerning casting throughput. The so called jumbo casting spouts have an internal cross section for maintaining the desired throughput which is so large that any alumina deposits will have no reducing effect on the casting speed. For smaller mold cross sections e.g. cross sections (having a width of for example 50 mm,) the dimensions necessarily have to be reduced and consequently the flow cross section for such a casting spout is reduced accordingly.

It is known through German patent 21 05 881 to reduce the inflow speed from the casting spout into the mold for continuous casting and in casting direction through a conically widened discharge pipe configuration and to make uniform that flow in the cross section of the mold. Such a discharge pipe is however preferred only for small or medium casting configurations and smaller slab ingots with dimensions such as 350×250 mm or 1000×300 mm.

DESCRIPTION OF THE INVENTION

It is an object of the present invention to provide a casting spout of the kind referred to above such that on continuous casting flat slab ingots of large width, a favorable distribution of flow into the mold is attainable for high casting throughput.

This objective is attained in accordance with the invention through the following features the casting spout widens in down direction conically in one plane only and is narrow in a plane transverse to the one plane, and that a still lower portion below the conical arm offers a lengthwise cross-section that extends over its height with an outlet zone having a length width ratio from 20:1 to 80:1.

The inventive casting spout makes it possible for the given length to width ratio of 20:1 to 80:1 to maintain the previous casting throughput but now also for very narrow continuous casting molds. Another advantage is to be seen in the cooperation with a smooth wall for the molds for continuous casting having low manufacturing cost.

A favorable distribution of flow is moreover attained in that the upper portion in cross section is round and that the lower long portion is rectangular whereby between the two sections there is provided the conical transition.

Further improvements of the invention provide that the wall thickness of the lower spout portion is at the most 10 mm. Another improvement of the invention provides that the lower spout portion is at least partially made of a fireproof, thermostock resisting material which is also resistant against casting powder slag while the main components are ZrO with additives or graphite and/or silicon carbide and/or boron nitride and/or a high melting metal and/or a high melting metal compound.

A feature concerning the professional manufacturing of the discharge pipe is to be seen in that the upper portion and the lower portion can be manufactured by means of partitionable core segments. In particular, extremely narrow lower casting spout portions have a throughflow opening that is correspondingly narrow and may be as narrow as 10 mm or less. For this purpose one will preferably establish a hollow space by means of combined core segments, which space is configured preferably in a manner that favors flow conditions.

In the case of wall thickness of about 10 mm the manufacture of such a discharge pipe must be made very carefully under consideration of a particular technology. For this reason it is suggested that the steel core has an axially removable central core as well as withdrawable lateral cores which can be removed through the entrance opening as well as auxiliary cores which can be displaced towards the center and then also be removed axially. This feature permits distructionfree and damagefree removal of the steel core upon making the casting spout.

Another advantage for the manufacture of casting spouts results from isostatically press working the fireproof material around the steel core such that the forces as they arise during the working bear always onto the central core.

DESCRIPTION OF THE DRAWINGS

An embodiment of the invention is shown in the drawings and will be described in greater detail below.

There is illustrated in FIG. 1 a vertical section view through a discharge pipe being in an operating position for plug control as illustrated.

Figure 1:
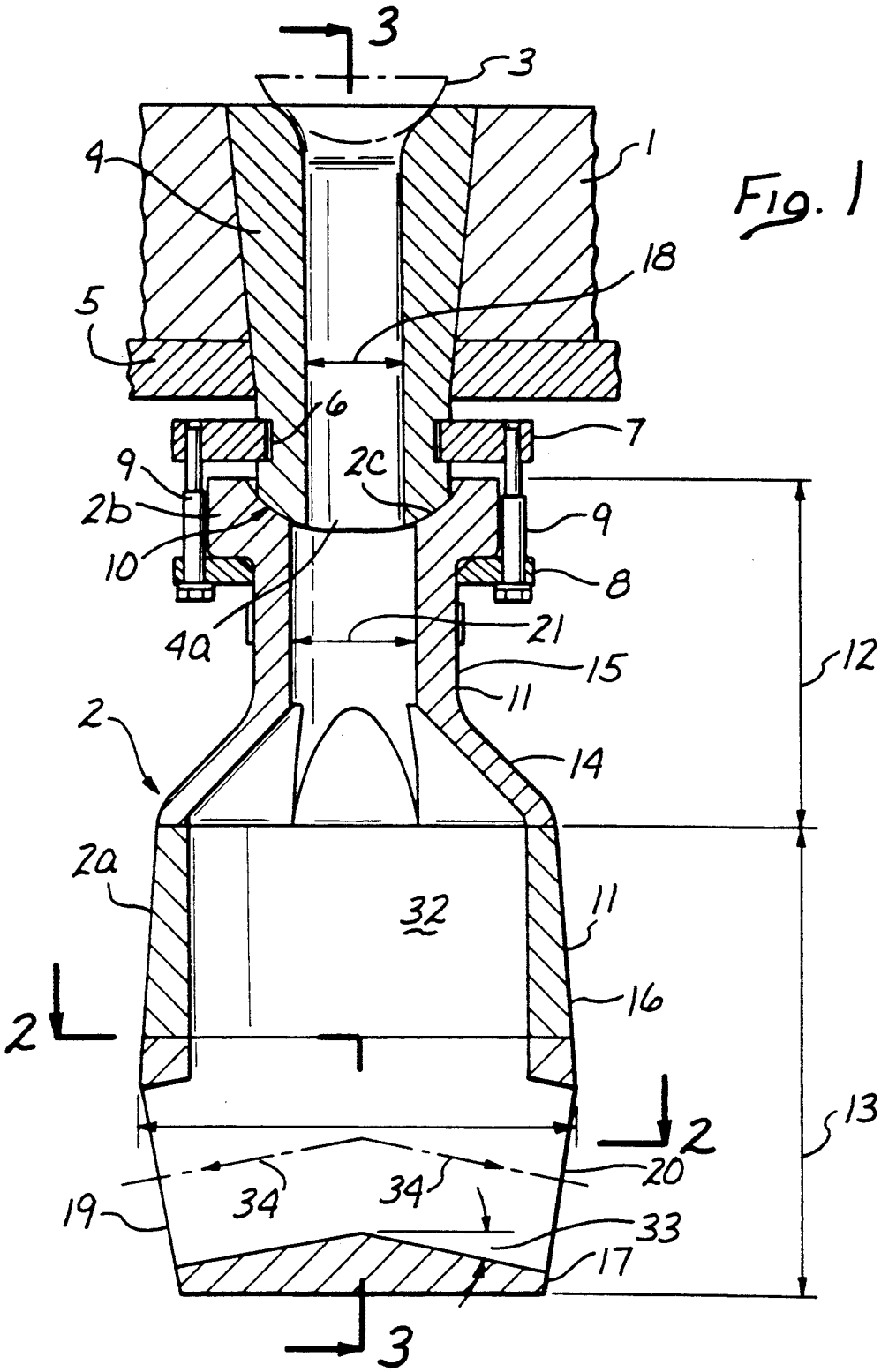

A first holding plate 7 is laterally shifted into a groove 6. A second holding plate 8 grips under a flange 2*b* of the casting pipe 2 which forces by means of pairs of threaded bolts 9 the discharge pipe 2 i.e. more particularly its flange 2*b* against the spherically formed end 4*a* of the entrance tube 4. Herewith a tight and sealed seat 10 is established through the spherical shape of the tube end 4*a* which matches a concave contour 2*c*.

Figure 2:
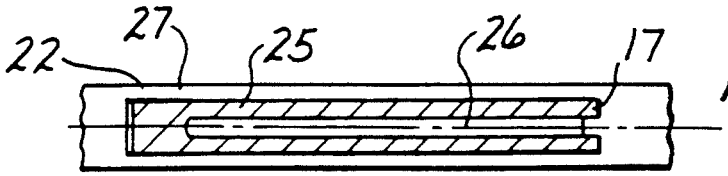
FIG. 2 is a horizontal cross section corresponding to the section II—II in FIG. 1.
Figure 3:
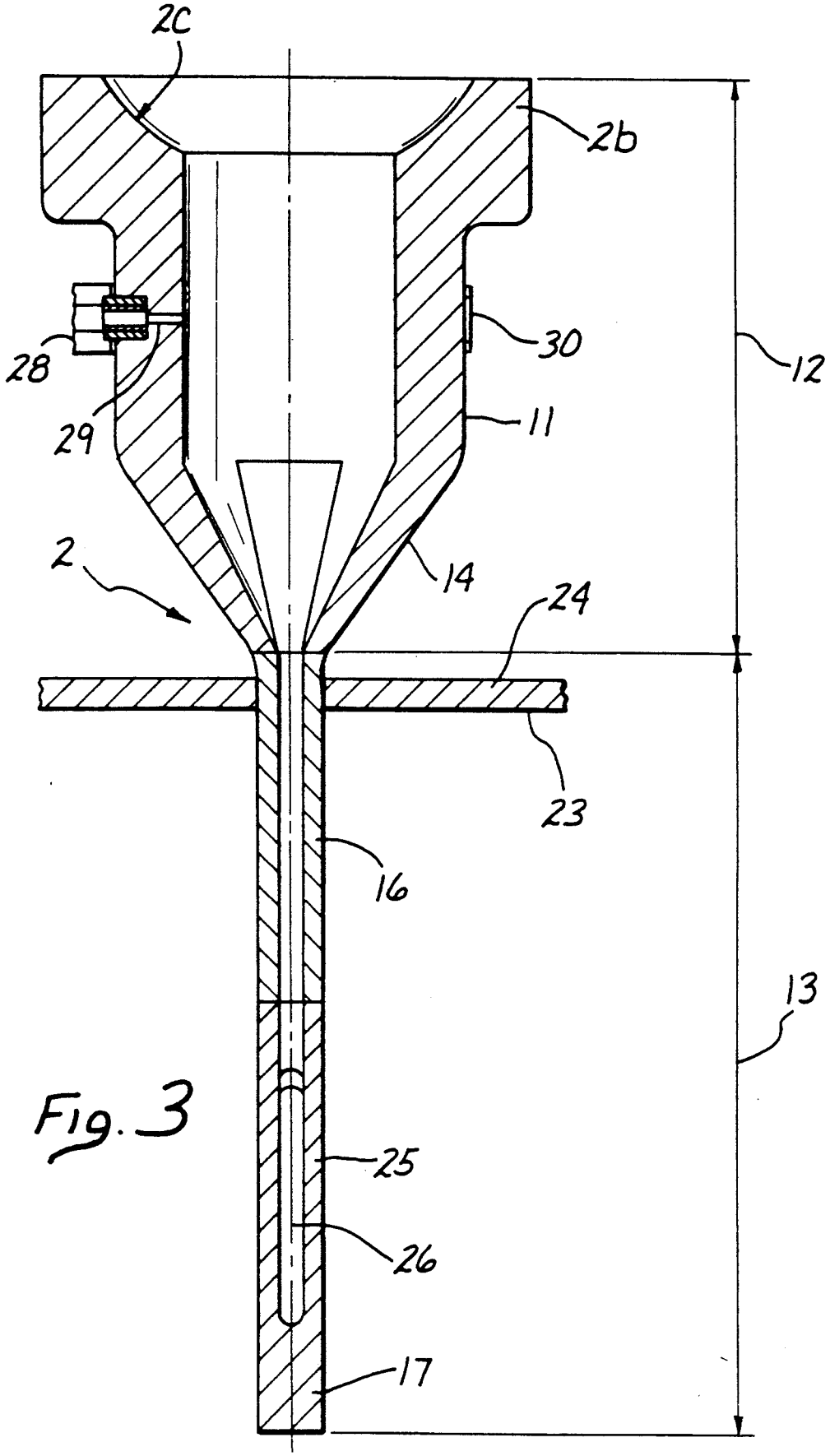
FIG. 3 is a longitudinal section in right angles to FIG. 1 and corresponding to the section plane III—III in FIG. 1 and The discharge pipe 2 which in the following will also be referred to as casting spout 2*a* is connected to a perforated brick 1 of a storage vessel (tundish). The kind of fastening as well as the means of fastening depend on whether or not the plug type closing 3 or a non-illustrated slide gate is provided. In the illustrated example an inlet tube 4 for the plug closure 3 is embedded in the perforated brick 1 which inlet tube 4 traverses a sheet metal jacket 5 and is spherical contoured at its lower end 4*a*.

The discharge or pipe 2 which in the FIGS. 1–3 is illustrated as a casting spout 2*a* is established through a tubular shaft 11 below the holding plate 8 which tubular shaft 11 is constructively partitioned into an upper length with portion 12 and a lower longitudinal portion 13. FIG. 1 establishes in this fashion a first longitudinal section plane in which the upper portion 12 has a narrow zone 15. Disregarding for the moment the conical transition 14, and the lower portion 13 is provided with an area 16 which as compared with the narrow zone 15 is considerably wider. The difference in the width between the areas 15 and 16 results from the length to width ratio which can be at least 20 to 1 and can be as high as 80:1 in the discharge zone 17, as compared with the cross sectional area 18 of the flow space through the entrance tube 4.

The lateral openings 19 and 20 together establish a cross section for flow which is not quite as large as the cross section available for flow at the plug closure 3. The openings 19 and 20 can of course be made still smaller since a particular control is exercised over the plug closure 3 as far as the flow of metal per unit of time is concerned. The plug seat at the plug closure 3 may have dimensions of about 4400 $mm^2$. The inner diameter 21 of the area 15 may e.g. be 95 mm in diameter. In such a case the openings 19 and 20 offer a flow cross section of about 2600 $mm^2$. The particular stated values refer to a mold for continuous casting 22 shown in FIG. 2 with a casting opening of 50 mm × 1600 mm.

The conical transition 14 is similar to the opening area 17 made of a thermoshock resisting material which is also resisting against flowing steel as described above, while the zone 16 in which is situated the casting level 23 is made of a material which is resistive against slag 24. This is indicated through different cross section hatchings in the drawings as far as zone 16 is concerned.

FIG. 2 illustrates the relations as they are determined in the lower portion 13 through the respective dimensions. The wall thickness 25 to the left and to the right of the cross section 26 is about 10 mm for an entrance opening 27 for the mold for continuous casting 22 which opening is about 50 mm wide. As can be seen particularly from FIG. 2, the cross section of the lower spout portion is narrow lengthwise, and the entire portion 13 is of considerable length extension in the vertical; see also FIG. 3.

As can be seen from FIG. 3 the tube shaft is provided with an argon feed with an inserted tubular connection 29 and a reinforcing ring 30.

We claim:

1. Casting spout for metallurgical vessels arranged upstream of a mold for continuous casting of thin ingots, the casting spout being fastened to and extends down from a tundish and being provided for purposes of feeding molten steel into the mold, the improvement comprising:

the casting spout having an upper inflow end and a lower outflow end, an upper portion of the spout at the inflow end being configured as a round tubular shaft portion;

said casting spout having downstream from the tubular portion a conically widening portion but being conically widened down from the round shaft portion in a first vertical plane only, and being accordingly relatively narrow in a plane extending at right angles to said first plane; and said casting spout being provided with a second still lower portion underneath the conically widened portion and having a rectangular cross section which extends over its height for a lengthwise cross section and terminates in an outflow area at said outflow end at a length-to-width ratio from 20:1 to 80:1 and a wall thickness of the second still lower portion of not more than 10 mm.

2. Casting spout as in claim 1 wherein the lower portion is at least in part made of fireproof, thermo-shock resisting and casting powder slag resisting material whereby the major component is Zr oxide and includes as additives, at least one of the following: graphite; silicon carbide; boron nitride; a high melting metal; at least one high melting metal alloy.

3. Casting spout as in claim 1, the lower portion being made of fireproof material that has been isostatically press worked around a steel core such that the forces as they arrive during press working always bear on the central core.

4. Casting spout for metallurgical vessels arranged upstream of a mold for continuous casting of thin ingots, the casting spout being fastened to and extends down from a tundish and being provided for purposes of feeding molten steel into the mold, the improvement comprising;

the casting spout having an upper inflow end and a lower outflow end, an upper portion of the spout at the inflow end being configured as a round tubular shaft portion, the lower end being closed except for two oppositely oriented, lateral outlet openings;

said casting spout having downstream from the tubular portion a portion that is conically widened down from the round tubular shaft portion in a first vertical plane only, and being conically narrowed in a plane extending at right angles to said first plane; and said casting spout being provided with a second still lower portion underneath the conically widened and narrowed portions and having a rectangular cross section which extends over its height for a lengthwise rectangular cross section and terminates in an outflow area at said lower end at a length-to-width ratio from 20:1 to 80:1 and a wall thickness of the second still lower portion of not more than about 10 mm.

* * * * *